US005560566A

United States Patent [19]

Bagnato

[11] Patent Number: 5,560,566

[45] Date of Patent: Oct. 1, 1996

[54] WINDER WITH ELEVATED SPOOL SUPPORT RAIL

[75] Inventor: Louis J. Bagnato, New Port Richey, Fla.

[73] Assignee: Beloit Technologies, Inc., Wilmington, Del.

[21] Appl. No.: 339,046

[22] Filed: Nov. 14, 1994

[51] Int. Cl.[6] ..... B65H 18/16

[52] U.S. Cl. ..... 242/541.1; 242/541.7; 242/542.3

[58] Field of Search ..... 242/534, 541.1, 242/541.4, 541.5, 541.6, 541.7, 542.3, 547

[56] References Cited

U.S. PATENT DOCUMENTS

| | | | |
|---|---|---|---|
| 1,951,715 | 3/1934 | Valentine et al. . | |
| 3,743,199 | 7/1973 | Karr et al. . | |
| 3,857,524 | 12/1974 | Melead et al. . | |
| 3,889,892 | 6/1975 | Melead . | |
| 5,184,787 | 2/1993 | Holzinger et al. . | |
| 5,370,327 | 12/1994 | Adamski | 242/533 |

FOREIGN PATENT DOCUMENTS

| | | |
|---|---|---|
| 0483092 | 4/1992 | European Pat. Off. . |
| 0483093 | 4/1992 | European Pat. Off. . |

OTHER PUBLICATIONS

"The New Optireel for Better Paper Reeling" by J. Tulokas & M. Kyytsönen; 79th Annual Mtg, Technical Sect., CPPA, pp. A255–A259.

"Improved Reel Structure with Optireel Reduces Amounts of Broke and Gives Better Roll Quality" by S. Renvall, Valmet (undated).

*Primary Examiner*—John M. Jillions
*Attorney, Agent, or Firm*—Dirk J. Veneman; Raymond W. Campbell; Gerald A. Mathews

[57] ABSTRACT

A winder in a papermaking machine has a frame with horizontal rails which are positioned above a rotatable reel support drum, which is fixedly mounted. As a relatively large diameter wound paper web reel, or jumbo, is formed on a spool riding on the rails, the surface of the jumbo remains tangent to the top of the support drum as the spool moves from an initial position vertically over the reel drum to a position laterally displaced horizontally along the rail. Centerwind drive(s) control spool torque. As the jumbo increases in size, it is moved linearly away from the initial position, while maintaining the paper web reel rotatively supported and in a nipping engagement with the support drum. Nip pressure between the support drum and the jumbo is controlled by the force of gravity and the horizontal positioning of the jumbo along the rails. The positioning of the jumbo along the rail may be controlled by a conventional pneumatic or hydraulic cylinder, or a screw mechanism. An alternative embodiment winder utilizes primary and secondary arms to position the jumbo and its spool along the reel rails.

8 Claims, 12 Drawing Sheets

WINDER WITH ELEVATED SPOOL SUPPORT RAIL

FIELD OF THE INVENTION

This invention relates to the reeling of a wound web roll. More particularly, this invention relates to the winder on a papermaking machine.

BACKGROUND OF THE INVENTION

Paper is made by a continuous process on a papermaking machine. Paper is formed at the wet end typically by depositing a slurry of paper fibers and water on a screen. The mat of fibers on the screen is dewatered by press rolls and suction boxes and transferred to a progression of rollers where it is pressed and dried. The final forming step is to run the web of formed paper through a calender or super calender which compresses the web between opposed rollers and improves the surface finish and the uniformity of paper thickness. All the processes involved in papermaking, from the forming of the paper at the wet end to calendering at the dry end are continuous in nature and each length of the paper is subjected to the same processes and forces, thus forming a paper web of high uniformity. However, the final step in the papermaking process, that of winding or reeling the paper web onto spools for removal from the papermaking machine, can result in non-uniform treatment of the paper web.

The reel of paper typically formed on a modern papermaking machine may have a diameter of 120 inches or more and a reel width of 200 to 400 inches. The paper on the so-called machine or jumbo reels is typically further processed by rewinding and slicing and sometimes coating the paper to form individual reels or sets to be used by paper-consuming customers such as newspapers. Studies performed in the past few years have shown that a paper web formed into the jumbo or machine reel can become damaged. The damage typically is in the form of tears near the edge of the sheet or creasing near the center. The damage typically results in the paper web breaking when it is further processed in a paper coating or rewinding machine or is utilized in a printing press.

A set is a smaller reel or roll of paper which has been formed from a jumbo reel. The last set is paper which is nearest the center of the reel, that is that paper first wound onto the reel spool. Studies have shown that at some paper mills, as high as 70 to 80 percent of all rejects on critical paper grades are from the last set off the reel. In one study, 73 percent of the press room paper web breaks during printing were in the last set off the reel, that is in the paper that was closest to the spool when the paper was wound in to a jumbo reel.

With increased papermaking speed and web widths, the size and weight of wound jumbos has also increased. In the past a certain percentage loss of paper due to reel defects was considered acceptable. However, with an increase in size of machine rolls, the problems associated with existing paper reels has been exacerbated while at the same time tolerance of product defects or waste of any kind has decreased due to increased competitive pressures and concern for maximum efficiency in the utilization of natural resources.

The solution to defects in the machine or jumbo reel is to produce a more uniformly wrapped paper web on the reel. The tightness or quality of the reel wrap depends on three factors: Tension, Nip pressure (including reel support for uniformity of nip pressure), and Torque. A paper winder employs a reel drum which is driven by the paper machine drive at a speed selected to impart a proper amount of tension. The tension is selected for a given grade and strength of paper and is typically 10–25% of the tensile strength of the given grade of paper. The web spool and the reel of paper built up thereon rides against the reel drum forming a nip therebetween. The nip compresses the paper which is wound onto the core. At the same time, the reel drum provides support at initial winding of the reel, the support continuing but diminishing as the jumbo reel increases in size.

Tension may be controlled by a centerwind assist drive which drives the machine reel. The centerwind assist is a differential torque drive with the differential torque controller controlling the amount of tension introduced into the web between the reel drum and the machine reel as it is built up on the core. European Patent Application Number 91850261.8 entitled "Reel-up and Method for Regulation of the Nip Pressure in a Reel-up" (Publication No. 0 483 093 A 1, published on Apr. 29, 1992) discloses a reel system which addresses some of the foregoing problems in the reel. The European Application disclosed employing a tilting rail which is pivoted about the axis of rotation of the reel drum. Riding on the reel is the core of the reel upon which the paper web is wound. The European Application discloses varying the angle between the rails and the horizontal such that the load of the nip formed between the machine reel and the reel drum remains uniform as the web is wound onto the machine reel.

Another type of winder system is the TNT™ System produced by Beloit Corporation and employs continuous control of the tension, nip and torque to produce machine reels of uniform density which are substantially less susceptible to the problems discussed herein. The Beloit TNT machine employs a horizontal rail located above a reel drum. The reel drum is vertically positionable and is controlled in response to a load cell which directly measures the nip pressure. The Beloit TNT machine solves the problems outlined above and produces a machine roll of uniform structure with minimal winder induced defects. Although the Beloit TNT machine provides a satisfactory solution to producing jumbo machine rolls of excellent uniformity, other approaches to the same problem are desirable. The papermaking industry has a large base of installed machinery of many differing makes and ages which are utilized to make a wide variety of papers and paper boards. Thus, more than one solution to a given problem may be advantageously employed.

What is needed is another approach to designing a winder with improved machine winder uniformity.

SUMMARY OF THE INVENTION

The machine winder of this invention employs a large diameter reel support drum mounted to a frame. Also mounted to the frame are reel rails which are positioned above the reel drum so that as the machine reel, or jumbo, (i.e. the web roll being wound) is formed on a spool riding on the rails, the surface of the jumbo remains tangent to the top of the reel drum as the spool moves from a position vertically over the reel drum to a position laterally displaced along the rails. Two centerwind drives are used to provide torque throughout the winding cycle. A start-up centerwind drive brings a new spool up to speed. As the machine reel grows in size, it is moved linearly, horizontally away from the reel drum. Nip pressure between the reel drum and machine reel is controlled by the force of gravity and the horizontal positioning of the machine reel along the rail. The positioning of the machine reel along the rail may be controlled by conventional pneumatic or hydraulic cylinders. The start-up centerwind drive remains engaged with a new spool up to a point where the jumbo has reached a predetermined jumbo reel diameter. As the jumbo reel grows in diameter, a secondary centerwind drive takes over at the opposite end of the reel spool and remains engaged to completion of the jumbo reel. The start-up centerwind drive is disengaged upon engagement of the secondary centerwind drive and returned to the initial position to bring the next reel spool to line speed. The centerwind drives are of the differential torque type so that the torque on the machine reel may be controlled with respect to the tension produced by the reel drum. An alternative embodiment winder utilizes primary and secondary arms to position the machine reel and its core along the reel rails. In prior art designs where primary and secondary arms controlled the reel, and the rail was located on the level with the reel drum, a discontinuity arose in the winding of the machine reel which is overcome in this invention by placing the machine reel above the reel drum and by continuously progressing the machine reel along the reel rail.

It is a feature of the present invention to provide a winder and method for reeling a web onto a wound web reel.

Another feature of the present invention is to provide an improved winder and method for producing a wound jumbo reel having few defects.

Another feature of the present invention is to provide an improved winder and method wherein the torque, nip pressure, and web tension can be applied and controlled in a paper web being wound through the entire reeling process without transfers or interruptions so producing a machine reel of improved uniformity.

Another feature of the present invention is to provide an improved winder rand method wherein the geometry of the winder minimizes reel spool and jumbo reel deflection due to gravity by providing drum support of the initial reel spool and partial drum support of the winding jumbo reel throughout the winding cycle.

Yet another feature of the present invention is to provide a winder of greater simplicity employing fewer parts.

A still further feature of the present invention is provide a winder for retrofit to existing paper machines in a cost-effective manner.

A still further feature of the present invention is to provide an apparatus and method for producing machine reels of large diameter and length with a reduced number of winder induced paper defects.

Other objects, features, and advantages of this invention will become readily apparent to those skilled in the art upon reading the description of the preferred embodiment in conjunction with the attached drawings.

DESCRIPTION OF THE PREFERRED EMBODIMENT

Figure 1:
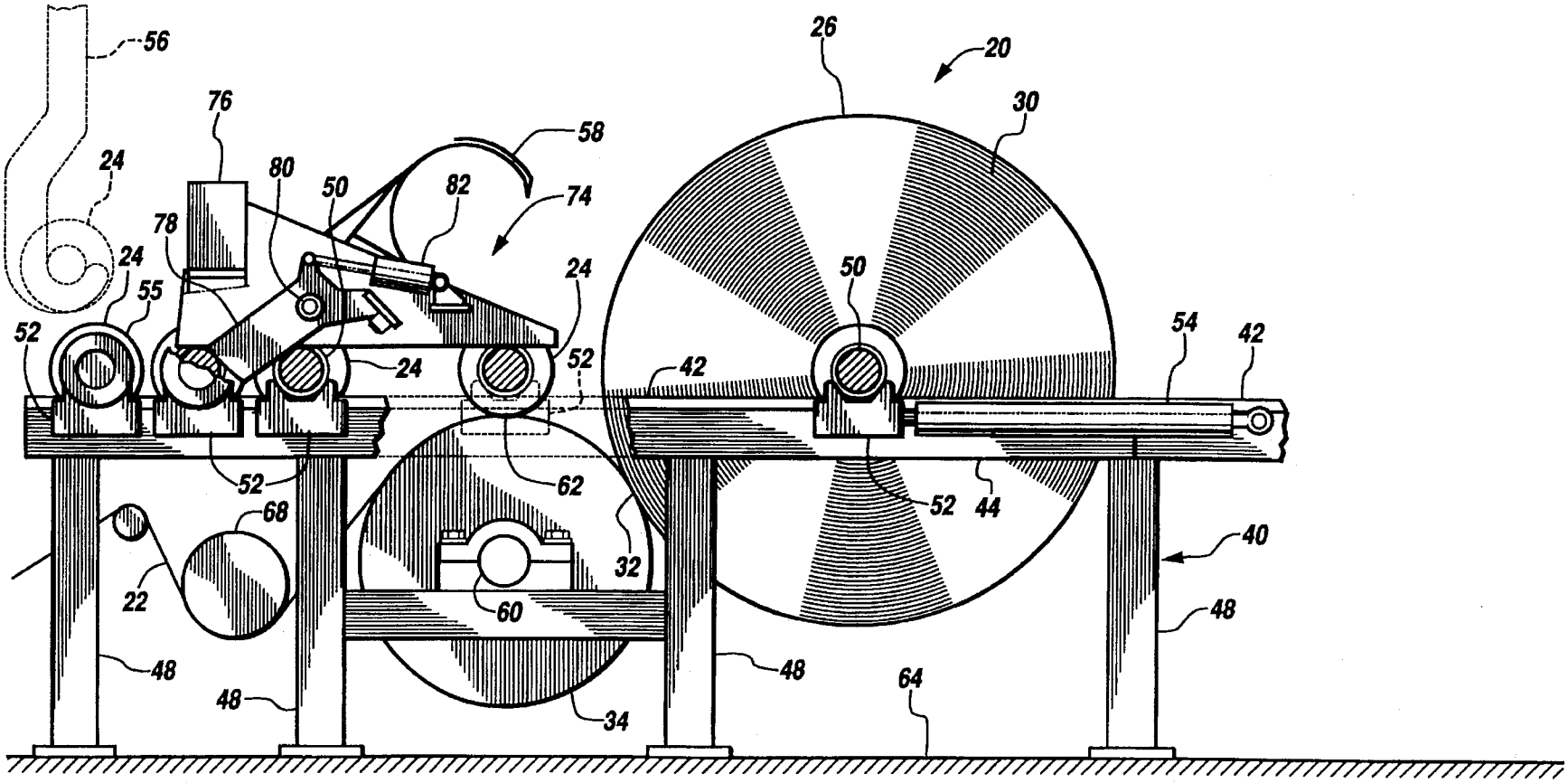
FIG. 1 is a side-elevational view of the winder of this invention showing reel spool storage and positioning apparatus.

Referring more particularly to FIGS. 1–12 wherein like numbers refer to similar parts, a winder 20 is shown in FIGS. 1–7. The winder 20 receives a paper web 22 from a papermaking machine (not shown) and winds the web 22 onto a reel spool 24 to form a jumbo or machine roll 26. The winder 20 is typically the last component of the papermaking machine and is the final step in the basic process of paper manufacture. Once the manufactured paper web 22 is formed into the large jumbo reels 26, the paper is severed from the papermaking machine and the wound reels of paper are removed for further processing or sale.

A typical jumbo reel may be as wide as four hundred inches and have a diameter of one hundred twenty inches or more. The large jumbo reel is typically sliced into smaller reels or sets of significantly smaller diameter and width. The paper may also be processed through a coater and/or supercalender to satisfy a particular user's requirements. As capacities for manufacturing paper webs of greater width and at higher speeds have increased, the jumbo reels have gotten commensurately larger. These larger reels are more subject to paper defects which are caused by the way the jumbo reel is wound.

The spool 24 on which the paper web 22 is wound is a long beam which can only be supported on its ends while paper is being wrapped thereon. Beam flexure loads on the spool are caused by the force of gravity acting on the paper 30 which is built up on the spool 24. Flexure of the beam formed by the spool 24 can result in defects in the paper web 22 when wound on the spool 24. These defects are typically concentrated in the paper immediately adjacent to the spool 24. Thus it has been observed that as much as seventy to 80 percent of the paper defects which cause such problems as paper web breaks during processing or printing on the paper, occur in the last set off the reel.

Figure 8:
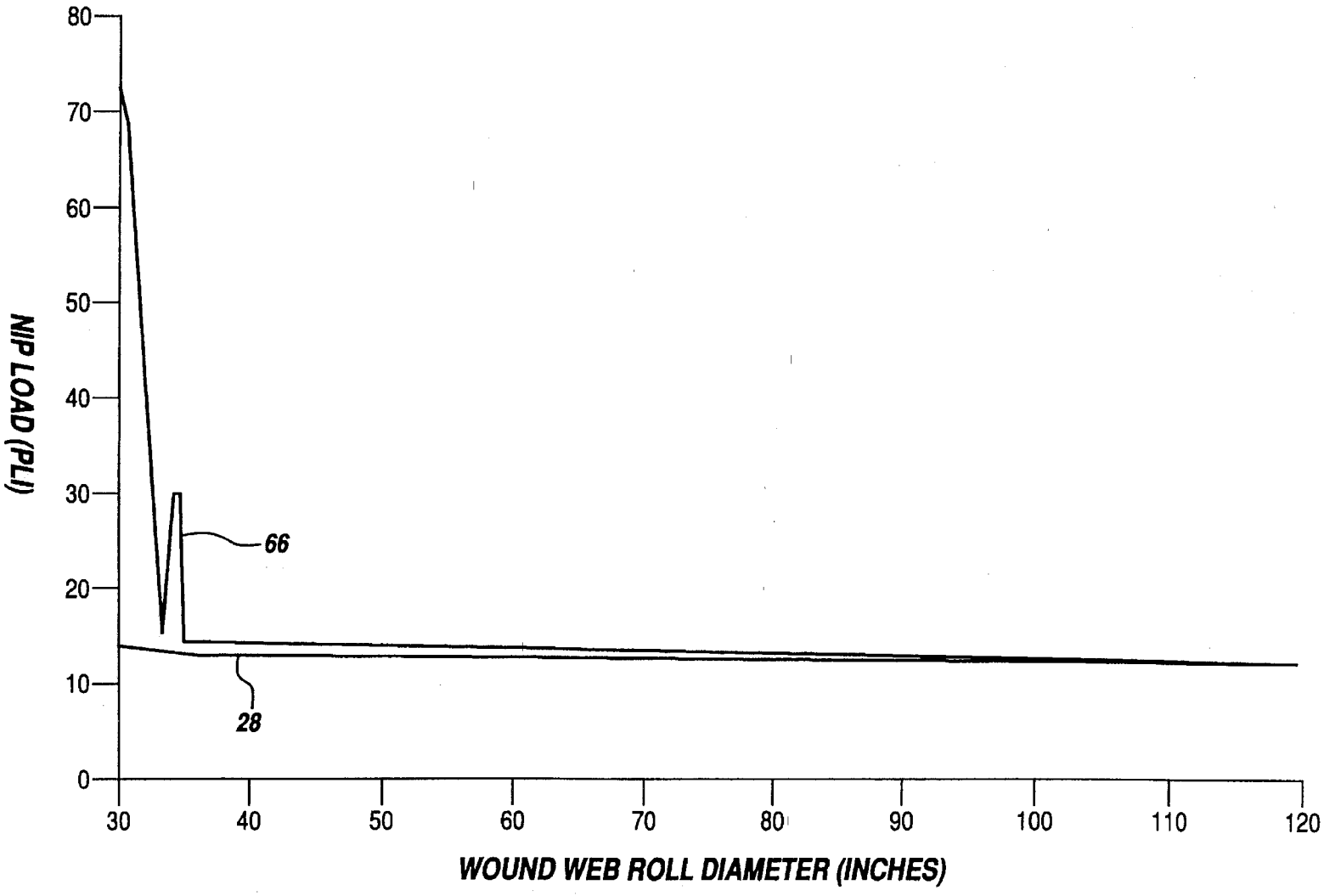
FIG. 8 is a graphical view comparing prior art nip loads with the uniform nip loads of the winder of FIG. 1.
Figure 9:
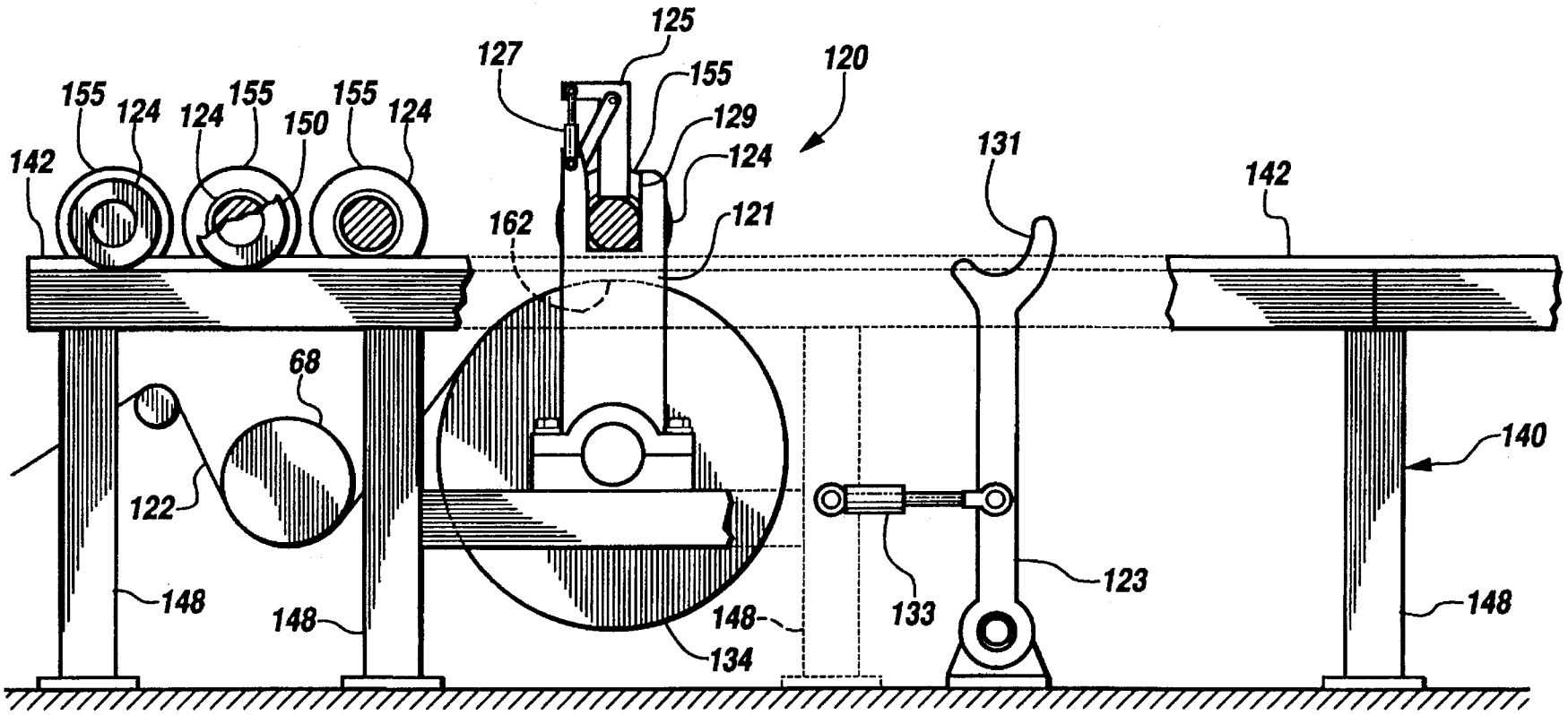
FIGS. 9–12 are schematic side-elevational views showing the progression of the machine reel as it is wound on an alternative embodiment of the winder of FIG. 1 wherein arms are employed to control the position of the machine reel on the reel rails.

By uniformly winding the web 22 onto the spool 24, the paper web co-acts with the spool to form a beam of greater thickness and stiffness which then in turn supports additional paper wound thereon. Thus, one aspect to avoiding defects in the jumbo reel 26 is to assure a uniform wrap, of gradual decreasing tension as the reel 26 diameter increases. A graphical plot 28 of the ideal nip loading for a jumbo reel 26 is illustrated in FIG. 8. The nip loading plot 28 shown in FIG. 8 shows a uniform nip loading which very gradually decreases as the reel diameter increases.

Figure 6:
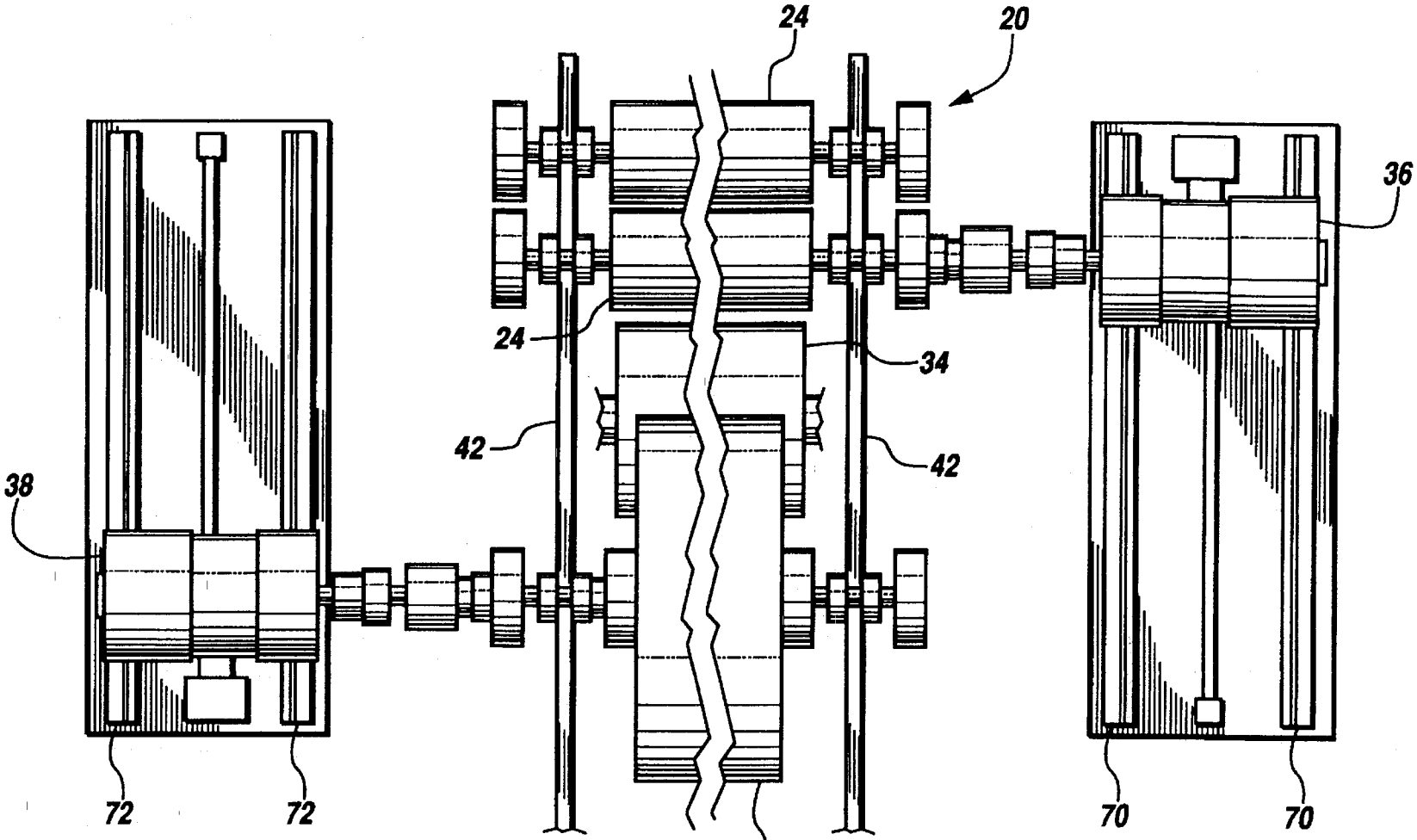
FIG. 6 is a top plan view of the winder of FIG. 1 showing the start-up and main centerwind drives.
Figure 7:
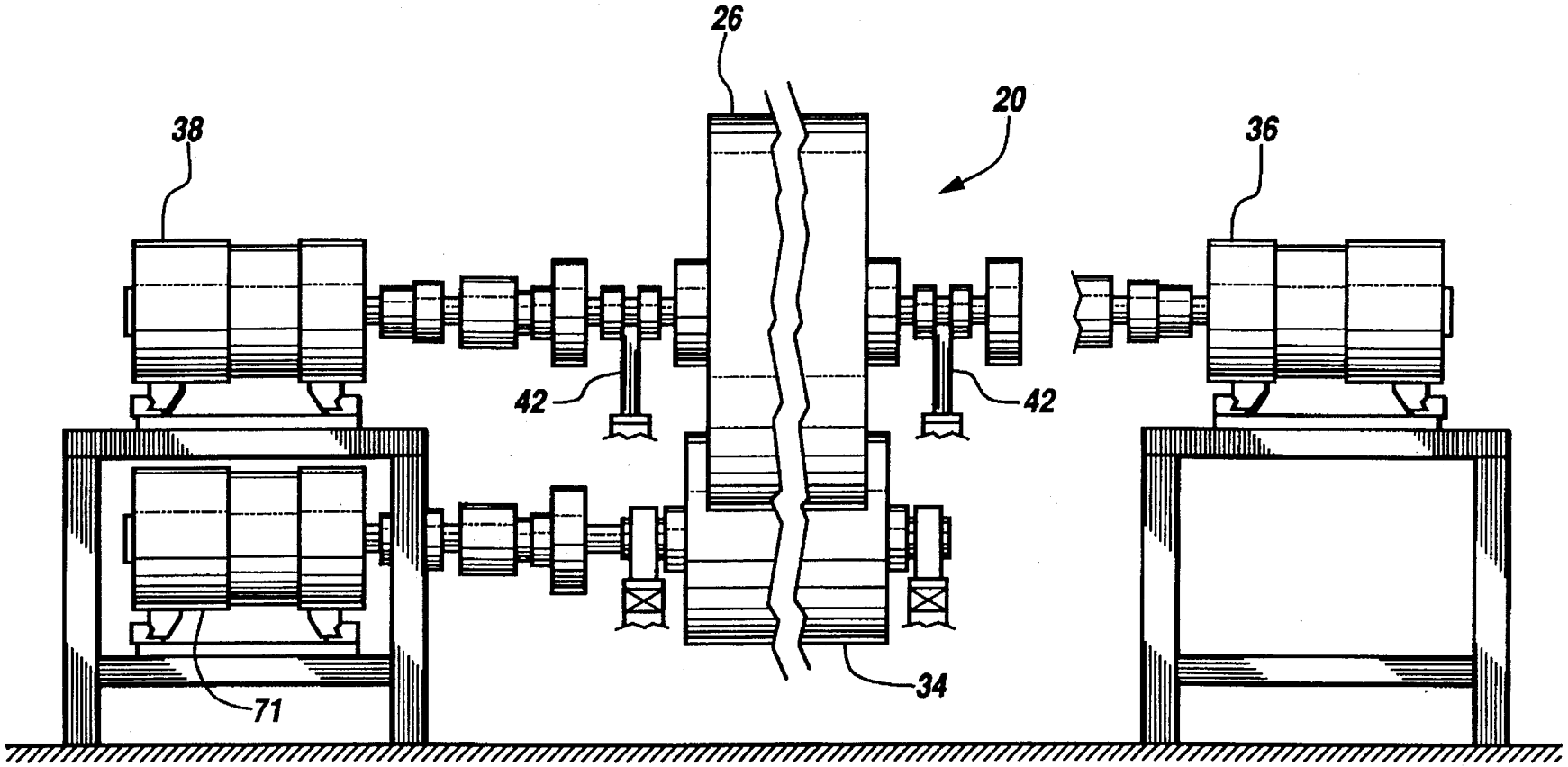
FIG. 7 is a cross-machine view of the winder of FIG. 1 showing the start-up and main centerwind drives.

The winder 20, as shown in FIGS. 1–7, will produce a jumbo reel 26 with reduced defects and improved reel structure by controlling the tension in the web 22, the pressure at the nip 32 between the spool 24 and the support drum 34, and the torque, which is controlled by driving the jumbo reel 26 with a center line assist drives 36,38, as shown in FIGS. 6 and 7.

Referring to FIG. 1, the winder 20 has a frame 40 with two rail support beams 44 which support horizontal rails 42. The rail support beams 44 are mounted to the floor or foundation 64 by post members 48. A supply of spool reels 24 are supported on the rails 42 on bearing housings 50. The bearing housings '50 roll on the rails 42 to permit horizontal translation movement of the reel spools 24 over the rails. When the bearing housings 50 are stationary, the spool reel 24 can rotate while supported in its bearing housings 50.

Figure 2:
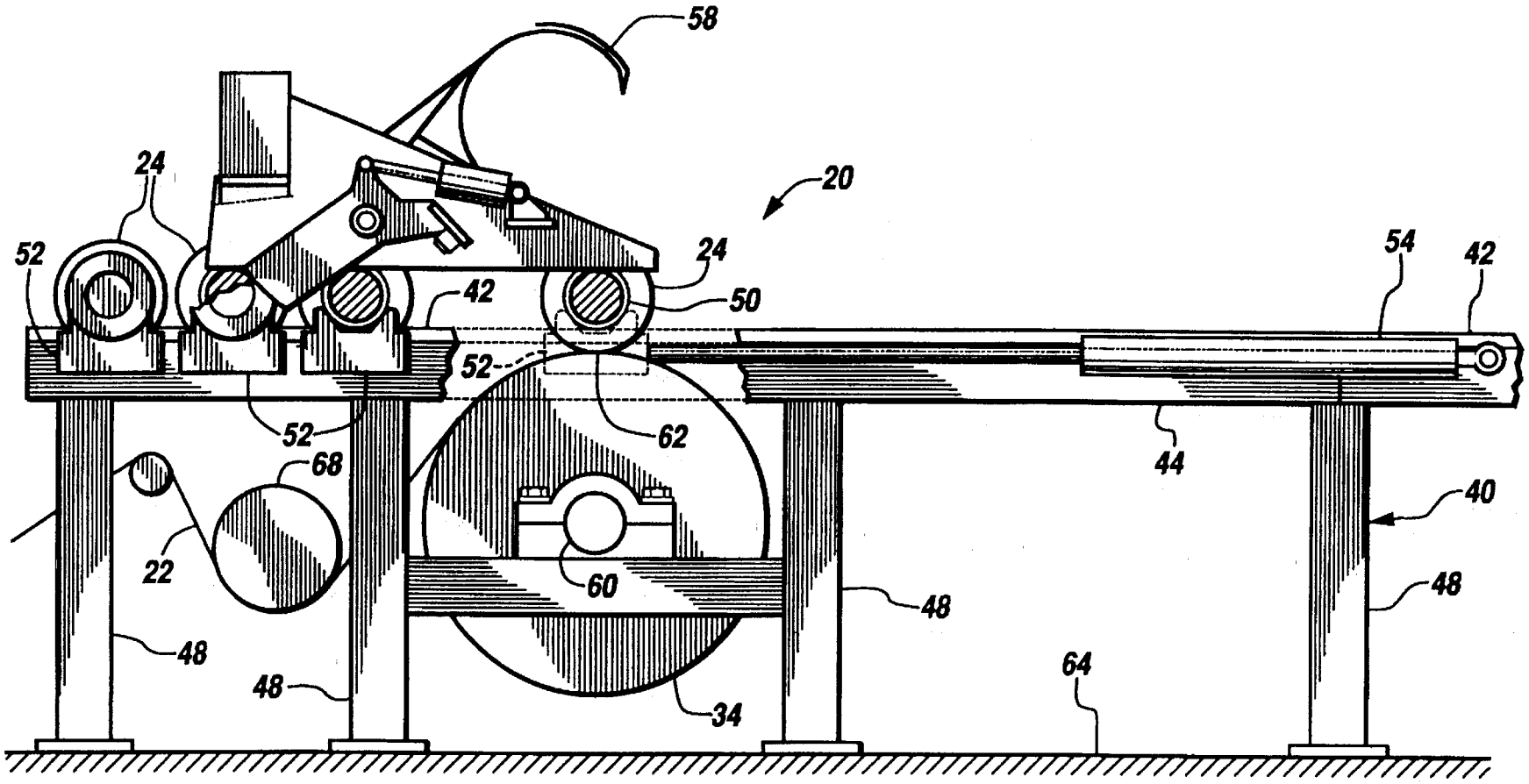
FIGS. 2–5 are schematic side-elevational views showing the progression of the machine reel as it is wound.

Carriages 52 engage the bearing housings 50 and allow the spools 24 to be urged along the rail by an actuator 54. Alternatively a pneumatic or hydraulic cylinder may be employed. A crane hook 56 supplies the spool reels 24 to the rails 42. The next spool to be wound is positioned directly over the support drum 34 where a conventional web turn-up device 58 severs the web 22 from the jumbo reel 26 and wraps the web 22 onto the spool 24 positioned directly above the support drum 34. As shown in FIG. 2, the reel 24 positioned over the support drum 34 is positioned along the rails 42 by an actuator 54, such as a ball screw, or fluid-powered cylinder. The support drum 34 is fixedly mounted to post members 48 by a bearing 60 which defines an axis of rotation. The rails 42 pass over the apex 62 of the support drum 34.

Figure 3:
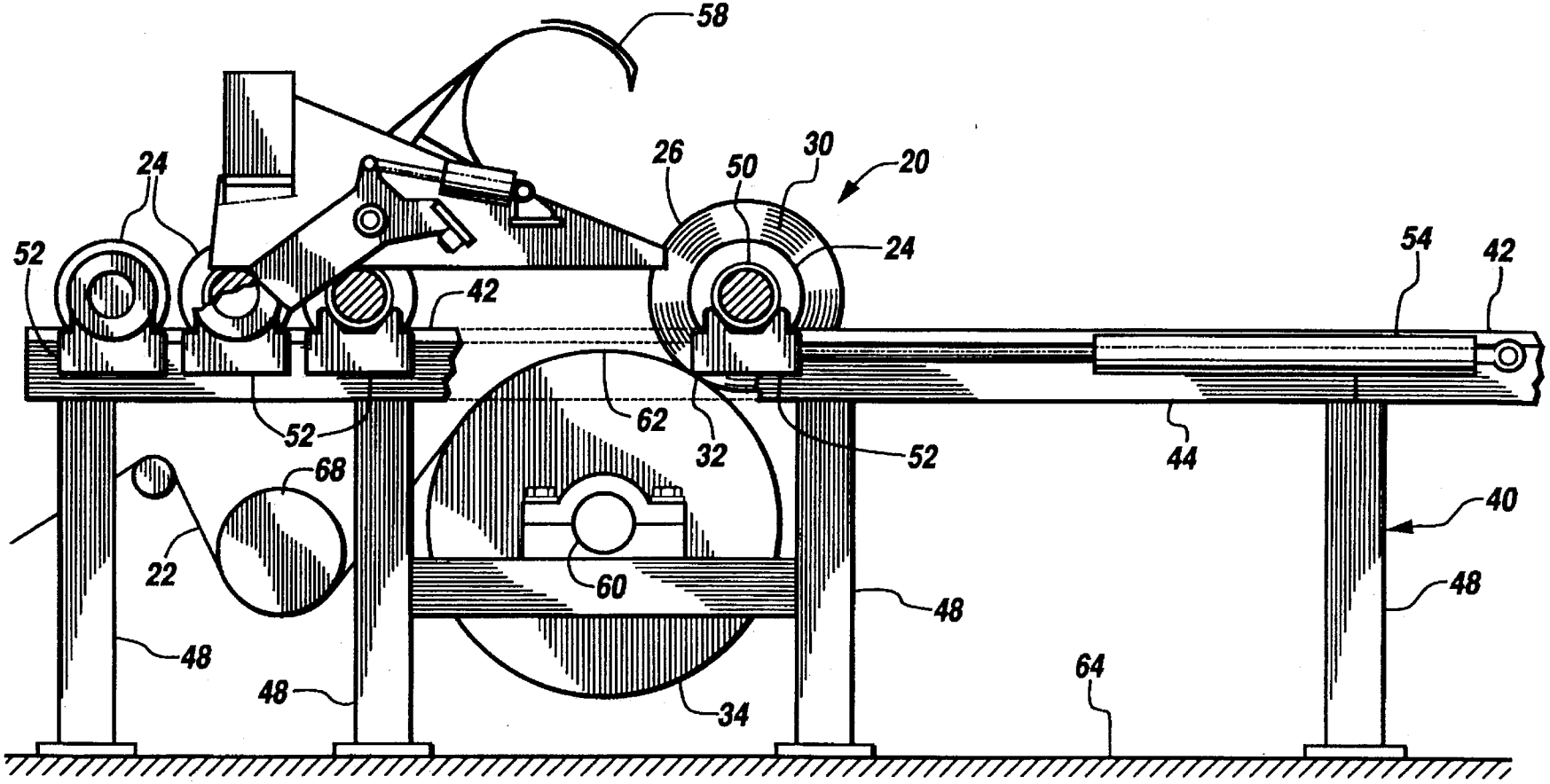
Figure 4:
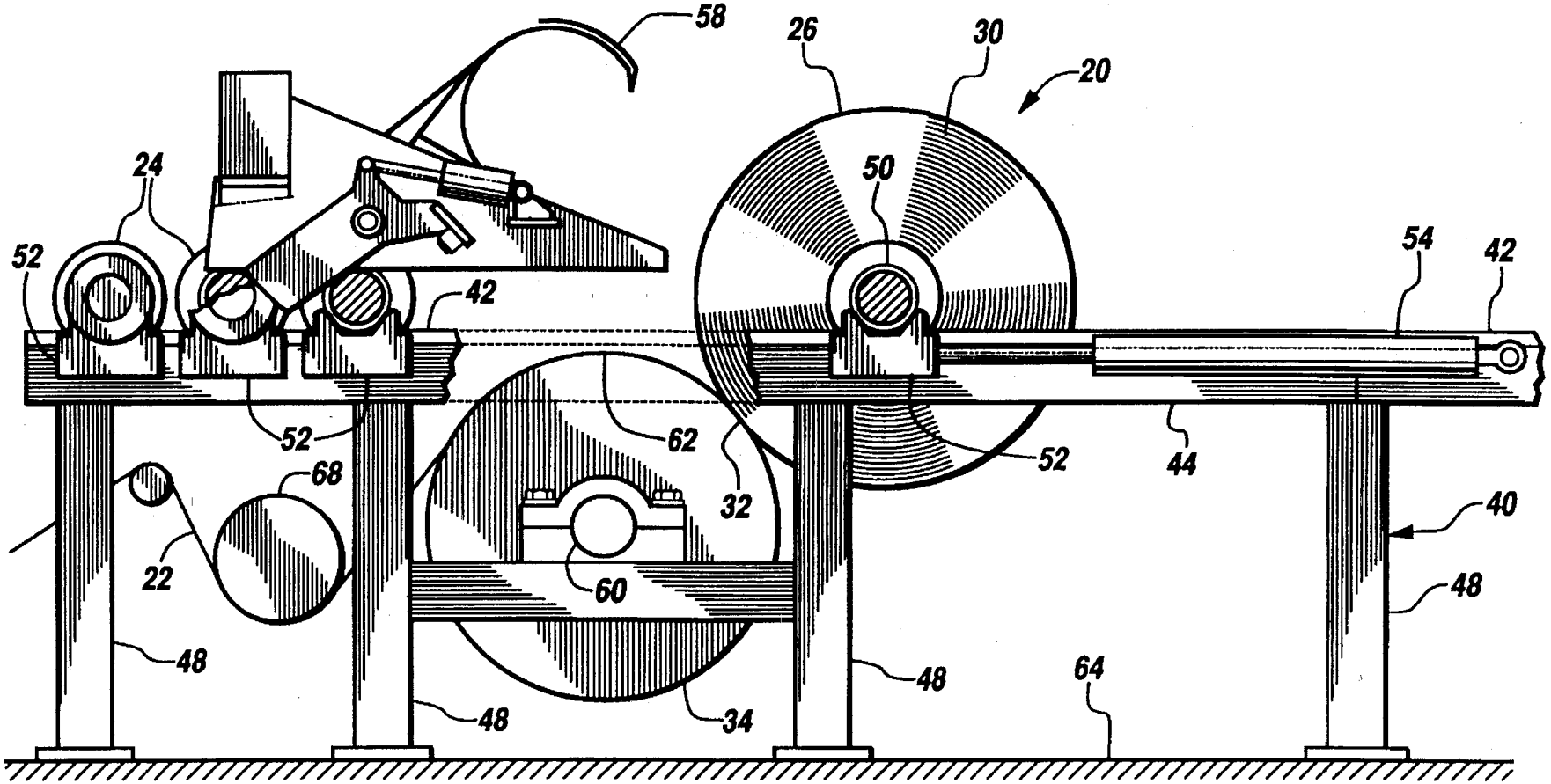
Figure 5:
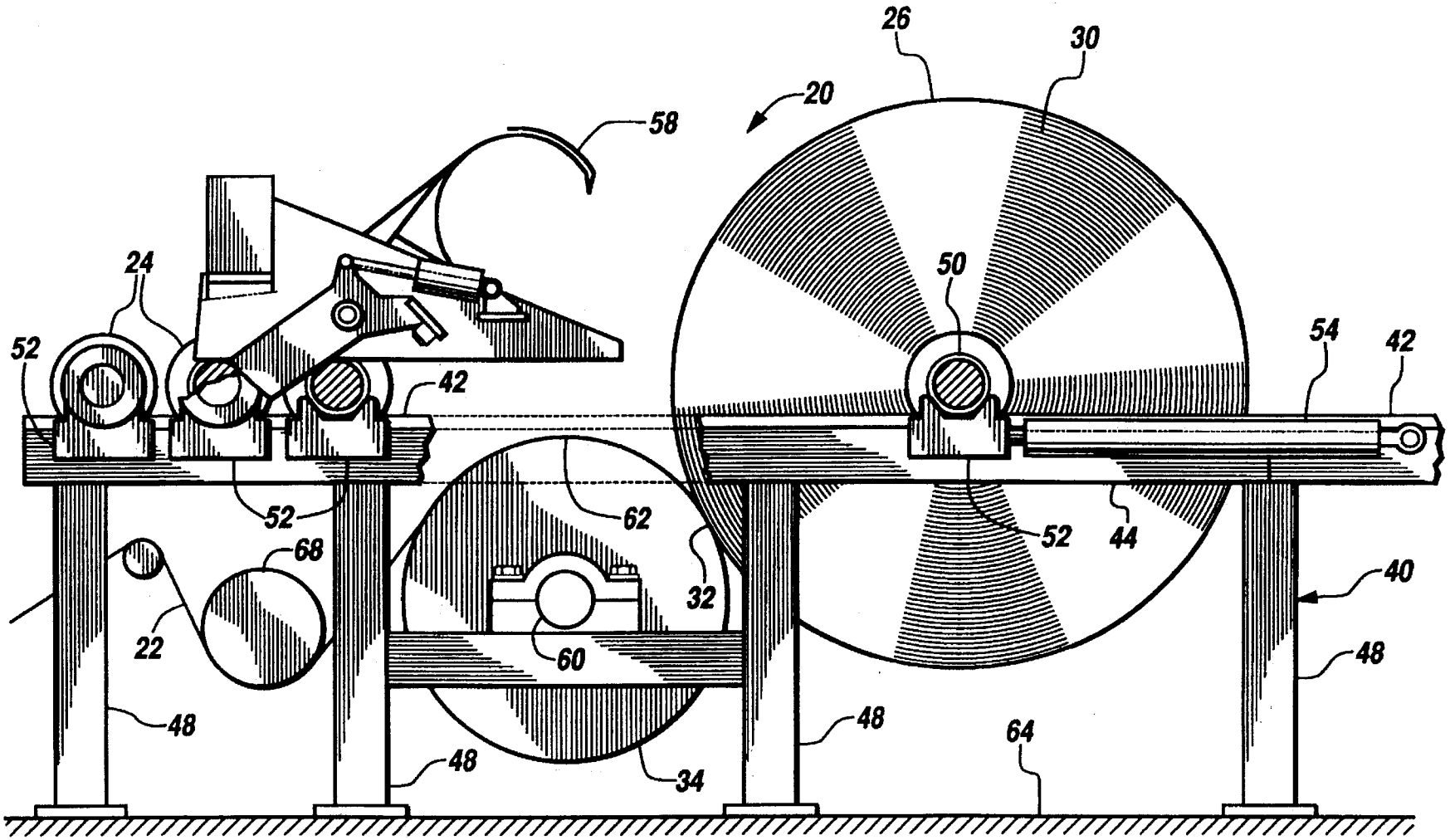

As the spool 24 begins to be wrapped by the web 22 the diameter of the incipient jumbo reel immediately begins to increase. If the jumbo reel remained at the apex 62 of the support roll 34, it would be lifted off the rails and would be supported entirely on the support roll. To retain the engagement of the bearing housing 50 with the rail, the partly formed jumbo reel 26 must move laterally away from the support drum apex 62 in the down machine direction as shown in FIG. 3.

In a conventional Pope-type winder, the nip loading of a jumbo reel against a support drum as a function of roll diameter is irregular as shown in curve 66 of FIG. 8. The variation in nip load shown by curve 66 is also indicative of the variation in web tension. These variations in the web structure are a result of winding the web onto a spool in two different positions. The first one being up machine of the apex of the support roll and the second position being on rails on which pass approximately through the axis of the support roll. Uneven winding is directly responsible for the damage to the paper immediately adjacent to the spool which forms part of the last set off the jumbo reel.

The winder apparatus 20, as shown in FIGS. 2, 3, 4 and 5, winds the web 22 onto the spool 24 in a continuous and controlled manner to form the jumbo 26. The three factors which must necessarily be controlled to produce a jumbo reel 26 of uniform wrap are the tension in the web 22, the load in the nip 32 between the jumbo reel 26 and the support drum 34 and the torque supplied by the centerwind assist drives 36,38. Tension in the web 22 is controlled by movement of the paper web 22 between support roll 68 and the support drum 34. The support roll 68 and support drum 34 are typically directly driven off the paper machine drive system or by individual drive motors 71, such as shown in FIG. 7. The support roll 68 and the drive drum 34 are controlled so that the web is stretched, thus imparting a tension in the web which is a percentage of the tensile strength of the web 22 being wound.

The pressure at the nip 32 is controlled by the weight of the spool and by the force exerted by the actuator 54 as the jumbo reel 26 builds up alongside the support drum 34. It may be desirable in some circumstances to have an additional means (not shown) such as a backing roll positioned above the spool when it is positioned at the apex 62 as shown in FIG. 2. It may also be desirable to mount the support drum on a load cell arrangement so that the loading of the jumbo reel can be monitored at all times. In some existing winders, the support roll provides the sole driving force for rotating the jumbo reel and so winding the paper web thereon. It has been found, however, that use of a differential centerwind assist drive controls the torque of the jumbo reel so as to improve the uniformity of wrap on the jumbo reel. Differential torque drives are conventional and allow a controlled amount of torque to be supplied to the jumbo reel directly as opposed to that supplied by the support drum 34.

As shown in FIG. 6, the jumbo reel 26 may be continuously driven by employing two centerwind assist drives 36 and 38. Each drive 36,38 is mounted on rails 70,72. Two drive arrangements are contemplated. In one arrangement, the centerwind drives 36 and 38 are of equal capacity and each drive is sized to maintain 100% of the torque requirement such that they can alternate between spools as they are wound into jumbo reels 26 with each centerwind drive engaging a new spool and maintaining driving engagement with the spool until the jumbo has completed being wound. Alternately, centerwind drives 36 and 38 may be differentially sized to suit specific torque requirements, with drive 36 having the lesser capability. An on-the-run shift may then be performed in which drive 38 takes over from drive 36 after the jumbo has reached a predetermined diameter, and engages the same spool, and completes the winding of the jumbo reel while the smaller drive 36 returns to the initial position to initiate the winding of a new spool 24.

As shown in FIG. 1, a spool guide apparatus 74 is mounted on the winder 20 from a cross machine support beam 76, located above the reel spools 24 in their storage position on the support rails 42, up machine from the support roll 34. The spool guide apparatus 74 utilizes a spool stop 78 which pivots about a pivot 80 by a hydraulic cylinder 82. By operation of this apparatus, in cooperation with a spool insertion device, a reel spool supported in the support carriages on either side of the apparatus is moved translationally horizontally from the storage position to an initial position.

The web turn-up device 58 is also mounted on the spool guide 74 and is used in urging the oncoming web 22 into wrapping engagement with a new spool 24 when it is time to begin winding the web 22 onto a new reel spool. The arrangement of the carriages 52 and their relation to the actuators 54 may be one of several configurations. Either a single pair of actuators, one of which is visible in FIGS. 1 through 5, may be utilized with the actuators 54 successively grabbing and pulling the carriages 52 forward. Alternatively, to assure continuous control over the carriages, and thus the spools, the carriages may be mounted on alternating tilting beams mounted on either side of the mils 42, such as shown in U.S. patent application Ser. No. 08/060,171 entitled "A Method and Apparatus for Reeling a Wound Web Roll", now U.S. Pat. No. 5,370,327, which is incorporated herein by reference. Another alternative is to have two actuators 54 in spaced parallel relation on either side of the rails and having every other pair of carriages 52 be of a design so that they can be grabbed and manipulated outward of the carriages gripped by the inner pneumatic actuators.

Figure 12:
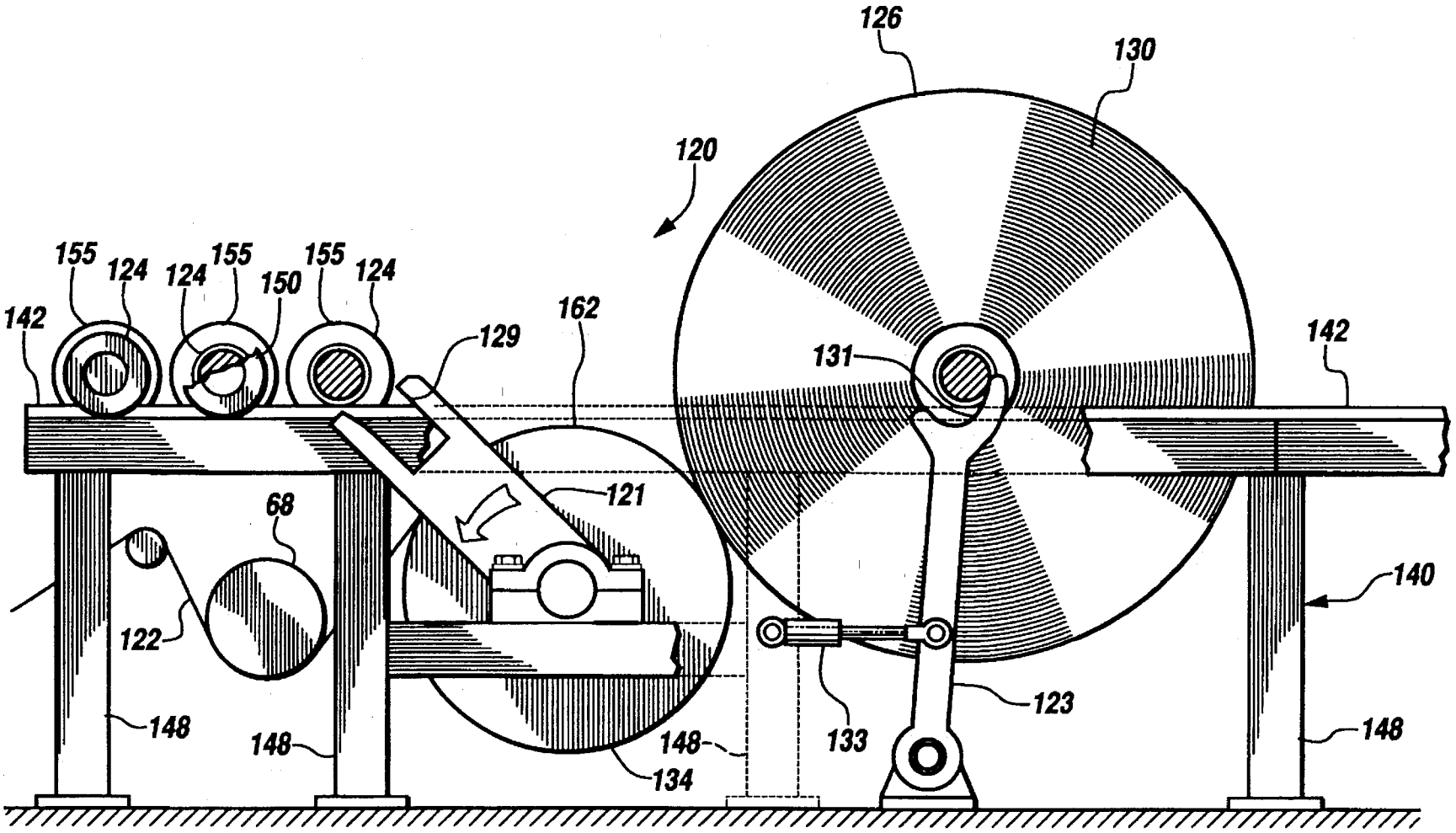

An alternative embodiment winder 120 is shown in FIGS. 9–12. The winder 120 employs a first arm 121 and a second arm 123 which control the position of a jumbo reel 126 with respect to the support drum 134. A supply of spools 124 is stored on rails 142. The first arm 121, as shown in FIG. 12, receives a spool 124 from the storage region of the rail and positions the spool 124 over the apex 162 of the support drum 134 where a conventional knife and turn-up device (not shown for clarity) initiate the wrap of the web 122 onto the spool 124.

Figure 10:
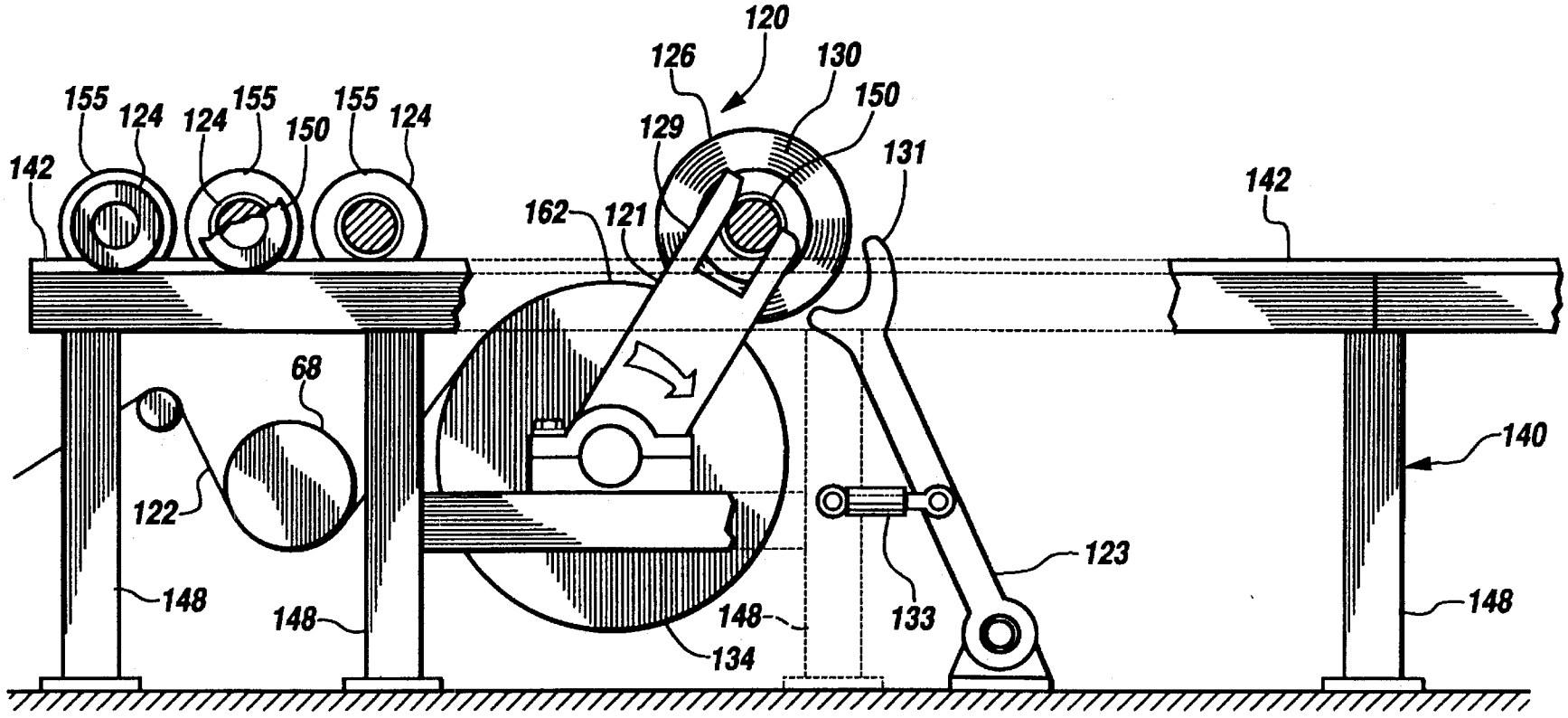
Figure 11:
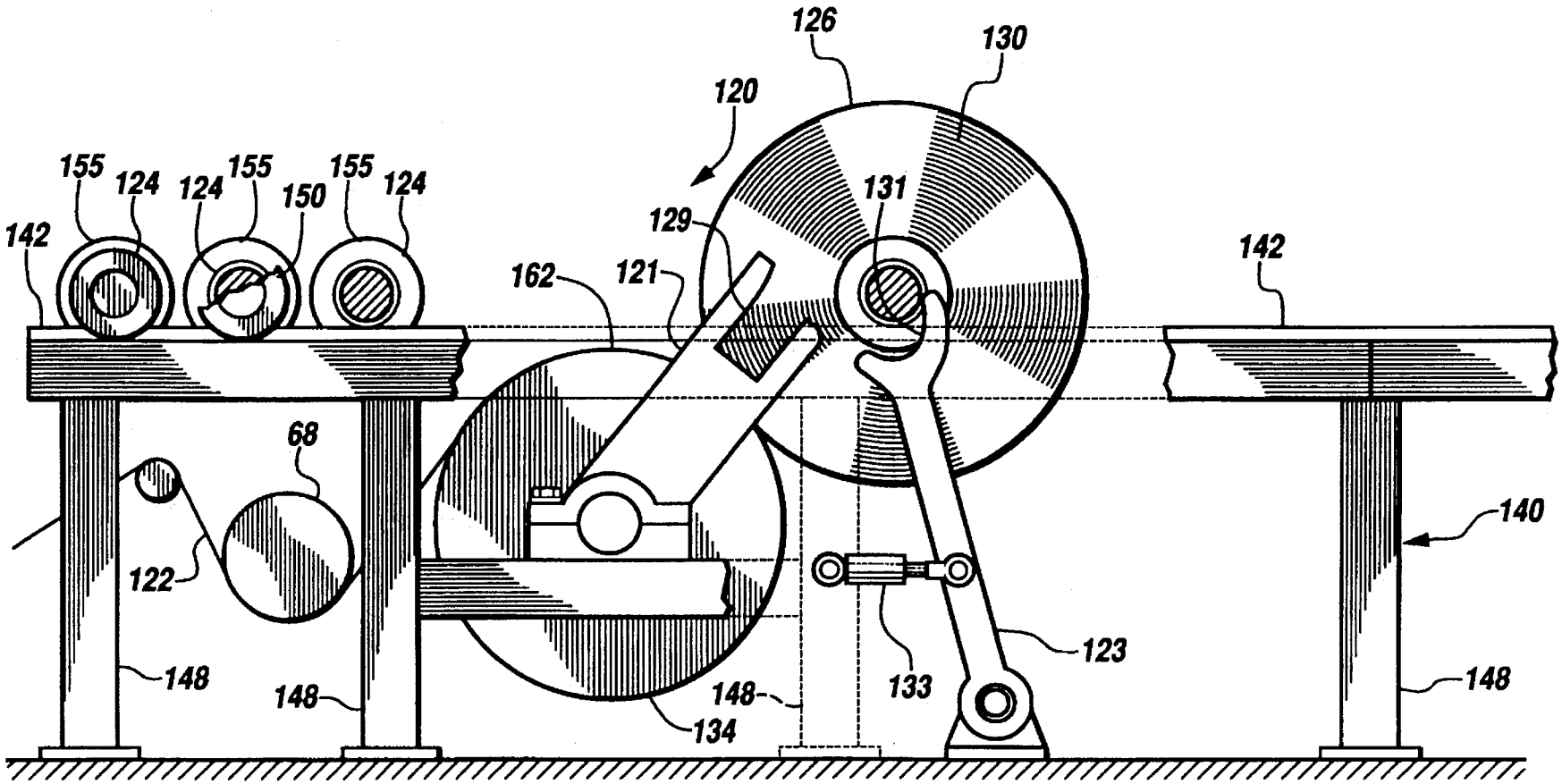

A downwardly biasing bar 125, actuated by a piston 127, may be employed to increase the nip loading between the spool 124 and support drum 134. For clarity, the clamping bar is shown only in FIG. 9. As the paper web 122 forms a built-up layer of paper 130 on the spool 124, as shown in FIG. 10, the arm is tilted in the down-machine direction, thus controlling the position of the bearing housing 150 on the rail 142. The first arm 121 is controlled by a piston or gear arrangement mounted between the arm 121 and the frame 140. This arrangement is conventional and not shown for clarity. As the reel increases in size, it leaves the control of fork 129 of the first arm 121 wherein it simultaneously comes under the control of the fork 131 of the second arm 123. The second arm is positioned by a piston 133 which is mounted to the post 148. The first arm 121 and the second arm 123 and the clamping bar 125 may be arranged so that a load cell detects the amount of force with which the spool 124 is held against the reel support drum 134. Alternatively, the reel support drum may be mounted on load cells to detect the nip loading between the support drum 134 and the jumbo reel 126. A centerwind assist is preferably used on the winder 120 and will be configured similar to the centerwind assist illustrated in FIGS. 6 and 7.

The advantages of the winders 20,120 is that the rails 42,142 which support the spools 24,124 are located above the apex 62,162 of the support drums 34,134. Thus, the spools 24,124 have outer circumferences 55,155 which are tangent to the apex 62,162 of the support drums 34,134, while the bearing housings 50,150 ride on the rails 42,142. Thus, this high positioning of the rail in the winders 20,120 allows the spool to be positioned above the support drum 34, 134 where the handling of the spools 24,124 and the initiation of the wrap of the web 22,122 onto to the spools by a web turn-up device are facilitated by the accessibility of the spool in the apex position. Further, as the spool rides in the apex, it is fully supported against gravity loads by the support drum 34,134. By positioning the rails over the support drum 34,134, the jumbo reel 26,126 remains under constant and uniform control such that the winding of the reel is more uniform, thereby decreasing the defects in the wound paper 30,130 immediately adjacent to the spool 24,124.

It should be noted that the invention is not limited to the particular construction and arrangement of parts herein illustrated and described, but embraces such modified forms thereof which come within the scope of the following claims.

I claim:

1. An apparatus for reeling a traveling web into a wound paper web reel on a reel spool, comprising:

a frame for mounting to a floor;

a pair of spaced, substantially horizontally disposed parallel rails mounted on the frame for supporting a reel spool and a paper reel formed thereon, the rails supporting the reel spool in substantially horizontal translational movement as the paper web reel is wound thereon;

a reel support drum rotatively mounted by a fixed bearing to the frame, the support drum having an apex which is beneath the rails at a distance such that the reel spool supported on the rails over the apex is in nipping engagement with the support drum, wherein the support drum engages the reel spool and the paper web reel formed on the reel spool along a nip during the reeling process, said nip beginning over the said apex and migrating downstream on the support drum during the reeling process, and wherein the entire paper web reel is formed on the reel spool and supported by the reel drum while the reel spool is engaged with the rails;

a pair of carriages in supporting engagement with the reel spool which carriages control the movement of the spool along the rails; and means for moving the carriages parallel to the rails with the reel spool in nip-controlled engagement with the support drum, the nip-controlled engagement by said means beginning at a location downstream of the apex of the support drum.

2. The apparatus of claim 1, further comprising:

a first centerwind drive mounted for translation parallel to the rails and in selective driving engagement with the reel spool during start of the reeling of the paper web reel on the reel spool, and in disengagement with the reel spool at a point in the reeling of the paper web reel when the paper web reel has reached a predetermined diameter; and a second centerwind drive mounted for translation parallel to the rails and in selective driving engagement with the reel spool during the reeling of the paper reel on the reel spool, beginning when the first centerwind drive disengages, and continuing in engagement until reeling is completed, the first centerwind drive and the second centerwind drive thereby working together to permit the winder to continuously form reels of paper on a multiplicity of reel spools.

3. A method of forming a traveling web into a wound paper web reel on a reel spool, the method utilizing a horizontally disposed support drum, comprising the steps of:

moving a reel spool to an initial position over the apex of the upper surface of the support drum;

rotatively supporting the reel spool in the initial position on a pair of spaced, substantially horizontally disposed parallel rails mounted to a frame for supporting the reel spool and a paper reel to be formed thereon beginning initially over the apex, the rails supporting the reel spool at a distance above the apex such that the reel spool supported on the rails over the apex is in nipping engagement with the support drum applying torque to the reel spool in its initial position to rotate and drive the reel spool;

maintaining the support drum rotatively mounted in a fixed position by a fixed bearing to the frame bringing a traveling paper web onto the reel spool in its initial position to commence winding the paper web into a paper web reel on the reel spool;

moving the paper web reel being wound substantially horizontally away from the initial position while maintaining the paper web reel rotatively supported and in nipping engagement with the support drum; and maintaining torque on the reel spool and nip pressure between the support drum and the wound paper reel in the winding position at desired levels until the paper web reel reaches a predetermined diameter.

4. The method of claim 3, wherein the step of maintaining torque includes rotating the spool while it is translating horizontally.

5. The method of claim 3, further comprising the steps of:

supporting the spool on the rails prior to its positioning at the initial position;

engaging the spool by a first arm prior to its transport to the initial position;

rotating the first arm to bring the spool into engagement with the support drum;

rotating the first arm as the paper web is wound on the spool to retain the paper reel in nipping engagement with the support drum; and engaging the spool with a second arm and pivoting the second arm to advance the paper web reel substantially horizontally as the paper web reel reaches its final diameter.

6. The method of claim 3, wherein:

the step of applying torque to the reel spool includes the engagement of the reel spool by a first centerwind drive mounted for translation parallel to the rails and in selective driving engagement with the reel spool during start of the reeling of the paper web reel on the reel spool, and in disengagement with the reel spool at a point in the reeling of the paper web reel when the paper web reel has reached a predetermined diameter;

the step of maintaining torque on the reel spool includes engagement of the reel spool by a second centerwind drive mounted for translation parallel to the rails and in selective driving engagement with the reel spool during the reeling of the paper reel on the reel spool beginning when the first centerwind drive disengages, and continuing until reeling is completed, the first centerwind drive and the second centerwind drive thereby working together to continuously form reels of paper on a multiplicity of reel spools.

7. An apparatus for reeling a traveling web into a wound paper web reel on a reel spool, comprising:

a fixed frame;

a pair of spaced, substantially horizontally disposed parallel rails mounted on the frame for supporting a reel spool and a paper reel formed thereon, the rails supporting the reel spool in substantially horizontal translational movement as the paper web reel is wound thereon;

a reel support drum rotatively mounted by a fixed bearing to the frame, the support drum having an apex which is beneath the rails at a distance such that the reel spool supported on the rails over the apex is in nipping engagement with the support drum, wherein the support drum engages the reel spool and the paper web reel formed on the reel spool along a nip during the reeling process, said nip beginning over the said apex and migrating downstream on the support drum during the reeling process, and wherein the entire paper web reel is formed on the reel spool and supported by the reel drum while the reel spool is engaged with the rails;

a first pivotally mounted pair of arms which selectively engage the reel spool, wherein the first pair of arms position the reel spool on the rails and control the position of the reel spool during formation of the paper reel on the spool; and a second pivotally mounted pair of arms which selectively engage the reel spool, wherein the second pair of arms receive the reel spool and the paper web reel formed thereon from the first pair of arms and control the positioning of the reel spool on the rails during at least the final formation of the paper web reel on the reel spool.

8. The apparatus of claim 7, further comprising:

a first centerwind drive mounted for translation parallel to the rails and in selective driving engagement with the reel spool during start of the reeling of the paper web reef on the reel spool, and in disengagement with the reel spool at a point in the reeling of the paper web reel when the paper web reel has reached a predetermined diameter; and a second centerwind drive mounted for translation parallel to the rails and in selective driving engagement with the reel spool during the reeling of the paper reel on the reel spool, beginning when the first centerwind drive disengages, and continuing in engagement until reeling is completed, the first centerwind drive and the second centerwind drive thereby working together to permit the winder to continuously form reels of paper on a multiplicity of reel spools.

* * * * *

UNITED STATES PATENT AND TRADEMARK OFFICE

CERTIFICATE OF CORRECTION

PATENT NO. : 5,560,566

DATED : 10/01/96

INVENTOR(S) : Louis Bagnato

It is certified that error appears in the above-indentified patent and that said Letters Patent is hereby corrected as shown below:

Column 6, line 51: "mils" should read --rails--.

Column 10, line 27: "reef" should read --reel--.

Signed and Sealed this

First Day of April, 1997

Bruce Lehman

*Attest:*

BRUCE LEHMAN

*Attesting Officer*

*Commissioner of Patents and Trademarks*